US005417259A

United States Patent [19]

Schneider

[11] Patent Number: 5,417,259

[45] Date of Patent: May 23, 1995

[54] FUEL DISPENSING NOZZLE WITH CONTROLLED VAPOR RECOVERY

[75] Inventor: Walter H. Schneider, Raleigh, N.C.

[73] Assignee: Emco Wheaton, Inc., Morrisville, N.C.

[21] Appl. No.: 257,363

[22] Filed: Jun. 9, 1994

[51] Int. Cl.[6] ..... B65B 3/36

[52] U.S. Cl. ..... 141/59; 141/DIG. 1; 141/44; 141/206; 141/302; 141/46

[58] Field of Search ..... 141/44–46, 141/59, DIG. 1, 206–227, 301, 302, 305

[56] References Cited

U.S. PATENT DOCUMENTS

| | | | |
|---|---|---|---|
| 3,016,928 | 1/1962 | Brandt | 141/45 |
| 3,826,291 | 7/1974 | Steffens | 141/59 |
| 3,850,208 | 11/1974 | Hamilton | 141/59 |
| 4,068,687 | 1/1978 | Long | 141/59 |
| 4,202,385 | 5/1980 | Voelz et al. | 141/59 |
| 4,429,725 | 2/1984 | Walker et al. | 141/59 |
| 4,649,970 | 3/1987 | Bower et al. | 141/302 |
| 4,687,033 | 8/1987 | Furrow et al. | 141/59 |
| 5,040,577 | 8/1991 | Pope | 141/59 |
| 5,150,742 | 9/1992 | Motohashi et al. | 141/59 |
| 5,217,051 | 6/1993 | Simpson et al. | 141/59 |
| 5,273,087 | 12/1993 | Koch et al. | 141/59 |
| 5,297,594 | 3/1994 | Rabinovich | 141/59 |
| 5,341,855 | 8/1994 | Rabinovich | 141/59 |

FOREIGN PATENT DOCUMENTS 3916691 11/1990 Germany .

*Primary Examiner*—Ernest G. Cusick

*Attorney, Agent, or Firm*—Bell, Seltzer, Park & Gibson

[57] ABSTRACT

A fuel dispensing nozzle with controlled vapor recovery including a fuel passageway, a main fuel valve in the fuel passageway, a vapor recovery passageway, a main vapor valve in the vapor recovery passageway, a manually operable trigger mechanism for controlling the main fuel valve to control the flow of fuel through the fuel passageway and for opening the main vapor valve, an auxiliary vapor valve in the vapor recovery passageway for controlling the rate of flow of vapor through the vapor recovery passageway when the main vapor valve is open, a fuel flow sensing permanent magnet in the fuel passageway and moveable responsive to the rate of fuel flow, and a follower magnet connected to the auxiliary vapor valve and magnetically coupled to the fuel flow sensing magnet for opening the auxiliary vapor valve an amount correlated to the rate of fuel flow to control the rate and thus the volume of vapor recovered in direct correlation to the rate and thus the volume of fuel dispensed.

6 Claims, 2 Drawing Sheets

FUEL DISPENSING NOZZLE WITH CONTROLLED VAPOR RECOVERY

FIELD OF THE INVENTION

This invention relates to fuel dispensing nozzles and more particularly fuel dispensing nozzles of the vapor recovery type.

BACKGROUND OF THE INVENTION

The use of vapor recovery fuel dispensing nozzles is becoming increasingly more prevalent because of environmental concerns and to meet environmental regulations. These nozzles are of several different types, but the nozzles for use in a vacuum assist vapor recovery system appear to be the nozzles of choice in most instances.

In vacuum assist vapor recovery systems, a vacuum pump or other positive flow inducing device creates a vacuum in the vapor recovery passage in the spout of the nozzle to draw vapor from the vehicle tank, through the nozzle and dispenser and to deliver the vapor into the underground tank from which the fuel is withdrawn by the dispenser. To avoid unduly pressurizing the underground tank, it is important to control the rate or volume of vapor recovered in proportion to the rate or volume of the fuel dispensed.

Various vapor recovery volume control systems have been proposed, but all have presented certain disadvantages or deficiencies. Some of these proposed systems have included fuel flow rate sensing means in the fuel line from the underground tank to the dispenser and some vapor flow control means in the vapor line from the dispenser to the underground tank. Examples of such systems are disclosed in U.S. Pat. Nos. 5,150,742; 5,040,577; 4,202,385; and 3,826,291. The systems disclosed in U.S. Pat. Nos. 5,150,742 and 4,202,385 disclose a hydraulic motor or turbine located in the fuel line and an impeller in the vapor recovery line for recovering the vapor. The hydraulic motor or turbine is connected to the impeller to drive the impeller when the motor or turbine is driven by the fuel dispensed. The system of the U.S. Pat. No. 3,826,291 drives the vapor recovery impeller from the shaft of the meter which records the amount of fuel dispensed.

Another type of vapor flow control system which has been proposed locates the vapor flow control in the delivery hose from the dispenser to the nozzle. Examples of this type of system are disclosed in U.S. Pat. Nos. 5,217,051; 4,068,687; and 3,016,928, in which rotary turbines and impellers are provided in the fuel delivery conduit and in the vapor recovery conduit of the hose.

Finally, it has been proposed to control vapor recovery from the nozzle by having a fuel flow responsive turbine drive a vapor recovery impeller. Incorporating such rotary elements in the nozzle imposes certain difficulties and maintenance problems and are not designed for use with vacuum assist vapor recovery systems.

SUMMARY OF THE INVENTION

With the foregoing in mind, it is an object of the present invention to provide a fuel dispensing nozzle of the vapor recovery type for use with a vacuum assist vapor recovery system and having vapor flow control in relation to the rate of fuel flow through the nozzle.

The foregoing object of this invention is accomplished by a fuel dispensing nozzle having a fuel passageway and a vapor recovery passageway therethrough with main valves in both passageways controlled by a manually operable trigger mechanism to open and close those passageways and to control the rate of flow of fuel through the fuel passageway. A fuel flow sensing device is located in the fuel passageway to sense the rate of flow of fuel. An auxiliary vapor valve is located in the vapor recovery passageway for controlling the rate of vapor flow therethrough and an actuating means for this auxiliary valve is responsive to the fuel flow sensing device for controlling the volume or rate of vapor flow in relation to the volume or rate of fuel flow.

BRIEF DESCRIPTION OF THE DRAWINGS

Some of the objects having been stated, other objects will appear as the description proceeds, when taken in connection with the accompanying drawings in which.

DETAILED DESCRIPTION OF THE PREFERRED EMBODIMENT

Figure 1:
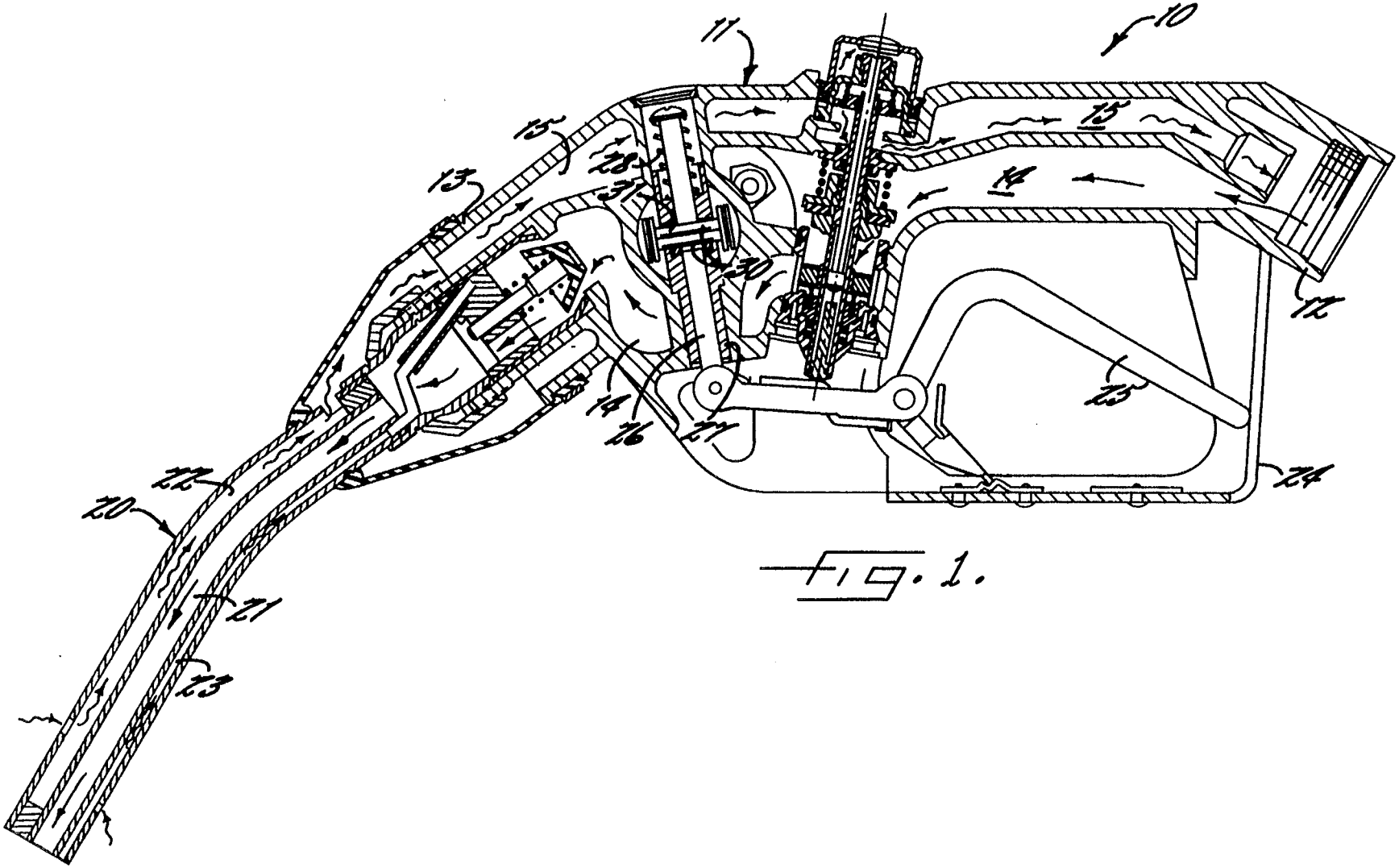
FIG. 1 is a longitudinal section of the nozzle incorporating the present invention.
Figure 2:
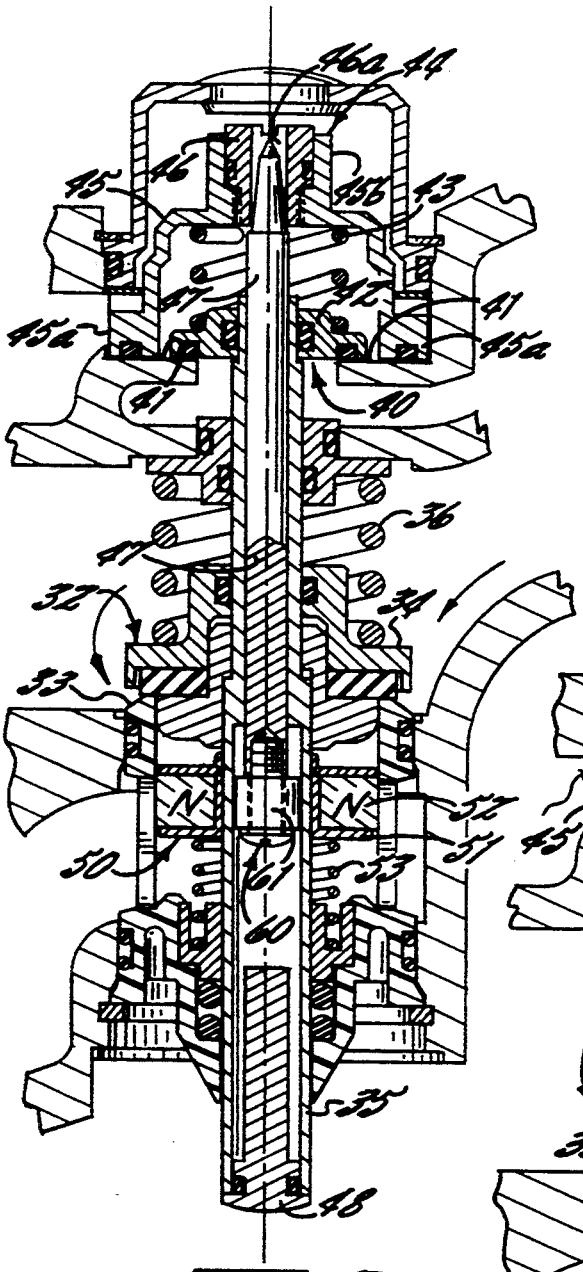
FIG. 2 is an enlarged fragmentary sectional view of the main fuel and vapor valves and of the auxiliary vapor valve shown in the medial portion of FIG. 1.
Figure 3:
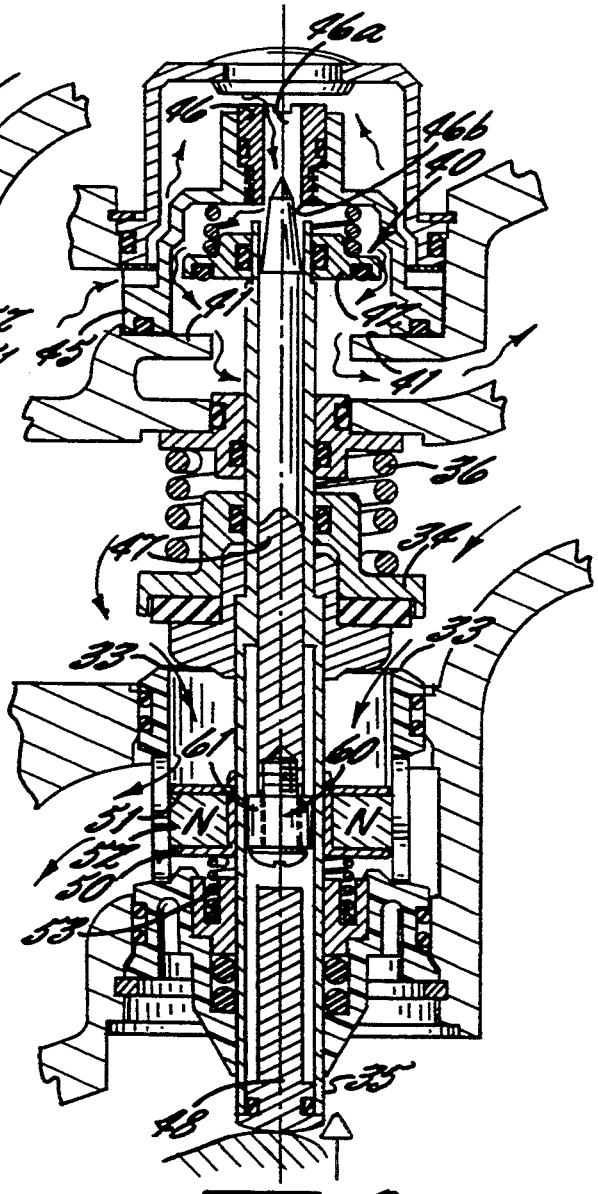
FIG. 3 is a view similar to FIG. 2 showing the valves in different operational positions.

Referring now more particularly to the drawings, there is illustrated a fuel dispensing nozzle generally indicated at 10 which incorporates the features of the present invention. Nozzle 10 includes a main body 11 having an inlet end 12 and an outlet end 13. Main body 11 has a fuel passageway 14 extending longitudinally therethrough from the inlet end 12 to the outlet end 13. Similarly, main body 11 has a vapor recovery passageway 15 extending longitudinally therethrough from the outlet end 13 to the inlet end 12.

A spout 20 is mounted on the outlet end 13 of the main body 11 and extends outwardly therefrom. Spout 20 has a fuel delivery passageway 21 extending longitudinally therethrough which is communicatively connected to the fuel passageway 14 in the main body 11. Spout 20 also includes a vapor passageway 22 therethrough which is communicatively connected to the vapor passageway 15 in the main body 11.

Nozzle 10 includes a full tank shut-off mechanism which includes a passageway 23 in spout 20 which is communicatively connected to a venturi and vacuum shut-off chamber (not shown). The shut-off mechanism is generally like the shut-off mechanism disclosed in the commonly owned U.S. patent application Ser. No. 07/963,581, filed Oct. 19, 1992, which disclosure is incorporated herein by reference.

Nozzle 10 further includes a hanger 24 for hanging the nozzle on a dispenser (not shown). A manually operable trigger member 25 is provided within the hanger 24 in position to be grasped by the user of the nozzle 10. Trigger member 25 is pivotally connected to a trigger latch member 26 which is slidably mounted in a bearing member 27. Trigger latch member 26 is spring biased toward the latched position by a spring 28.

Latch member 26 has a groove or slot 30 in one side thereof which is adapted to receive a pair of latch rollers 31. Latch rollers 31 are removed by the shut-off mechanism out of the groove 30 to unlatch the trigger latch member 26 and to permit the trigger latch member 26 to slide downwardly. Upon such downward movement, the pivot point of the trigger member 25 moves and the trigger member 26 becomes ineffective.

A main fuel valve 32 is provided in the fuel passageway 14 to control the flow of fuel through the fuel passageway 14 and through spout 20. Main fuel valve 32 includes a valve seat 33 surrounding the fuel passageway 14 at a medial point therein and a valve member 34. Valve member 34 is carried by a valve stem 35 which is slidably mounted in main body 11 with the lower end thereof in contact with the trigger member 25. Valve member 34 and valve stem 35 are biased downwardly toward the closed position by a main spring 36.

A main vapor valve 40 is positioned in vapor recovery passageway 15 in main body 11. Main vapor valve 40 includes a valve seat 41 surrounding a portion of vapor recovery passageway 15 and a valve member 42 carried by the upper end portion of valve stem 35. A spring 43 biases valve member 42 toward valve seat 41.

An auxiliary vapor valve 44 is provided in addition to the main vapor valve 40. Auxiliary vapor valve 44 includes a cup-shaped member 45 having its lower end **45*a* sealingly engaging the valve seat 41 radially outwardly of the area of valve seat 41 engaged by valve member 42. Valve member 42 and spring 43 are housed within the cup-shaped member 45. The upper end of cup-shaped member 45 has an upstanding boss 45*b* thereon and an opening extending through boss 45*b* and into the interior of cup-shaped member 45. A needle valve seat forming insert 46 is mounted in the opening through boss 45*b* and is hollow such that the lower end 46*b* of the opening 46*a* therethrough defines a valve seat for a needle valve member 47**.

Valve stem 35 is hollow and needle valve member 47 is slidably mounted within the hollow interior of valve stem 35. The lower end of the hollow interior of valve stem 35 is sealingly closed by a removable plug 48.

A fuel flow sensing means 50 is movably mounted in fuel passageway 14 downstream of main fuel valve 32 for sensing the rate of flow of fuel within fuel passageway 14 when main fuel valve 32 is open. Preferably, fuel flow sensing means 50 includes a nonmagnetic support member 51 slidably mounted on valve stem 35 and having a permanent magnet 52 mounted thereon for movement therewith. A spring 53 biases support member 51 and magnet 52 upwardly to a no-flow, neutral position.

Auxiliary vapor valve actuating means 60 is responsive to the fuel flow sensing means 50 for opening and closing the auxiliary vapor valve 44. Actuating means 60 preferably is a follower magnet 61 mounted on the lower end of needle valve member 47 and is magnetically coupled to magnet 52 for movement therewith.

In operation, the nozzle 10 is removed from the dispenser (not shown) and the dispenser is activated. The spout 20 is inserted in the fill pipe of the vehicle tank and the user pulls upwardly on the trigger member 25. Because the latch rollers 31 are positioned in the groove 30, the trigger latch member 26 is held against sliding movement and therefore the pivot for trigger member 25 is stationary.

Trigger member 25 engages the lower end of main valve stem 35 and moves valve stem 35 upwardly. Main fuel valve 32 is opened to permit fuel flow through fuel passageway 14, main fuel valve 32 and through spout 20 into the vehicle tank. The rate of flow of fuel through main fuel valve 32 is controlled and varied by the distance the trigger member 25 is moved upwardly and hence the distance the valve member 34 is moved away from the valve seat 33 by valve stem 35.

Simultaneously, valve stem 35 opens main vapor valve 40 by moving valve member 42 away from valve seat 41. Vapor flow through vapor recovery passageway 15 is still precluded because auxiliary vapor valve 44 is still closed in that the upper end of needle valve member 47 is still seated on valve seat **46*b***.

As fuel commences to flow through main fuel valve 32, the fuel flow sensing means 50 senses the rate of such flow since support member 51 and magnet 52 are directly in the flow path of fuel through the main fuel valve 32 and move downwardly against the action of spring 53 as fuel flows thereby. The higher the rate of flow of fuel, the farther downward magnet 52 will travel.

Since the follower magnet 61 mounted on needle valve member 47 is coupled magnetically to the magnet 52, any downward movement by magnet 52 will result in a concomitant downward movement of follower magnet 61 and of the needle valve member 47. As the needle valve member 47 is moved downwardly, the auxiliary vapor valve 44 is opened and vapor will be drawn through auxiliary valve 44 and then main vapor valve 40 by the vacuum assist (not shown). The distance the upper end of needle valve member 47 moves away from valve seat **46*b* determines the rate of flow of vapor through the vapor passageway 15. Since the amount the auxiliary valve 44 is opened is directly controlled by the rate of fuel flow through the fuel passageway 14**, the rate and thus the volume of vapor recovered is directly correlated to the rate and thus the volume of fuel dispensed.

In the drawings and specification, there has been set forth a preferred embodiment of the invention, and although specific terms are employed, they are used in a generic and descriptive sense only and not for purposes of limitation.

That which is claimed is:

1. A fuel dispensing nozzle having vapor recovery characteristics comprising a main body having inlet and outlet ends and a fuel passageway and a vapor recovery passageway therethrough between said inlet and outlet ends, a spout connected to said main body at said outlet end and having a fuel delivery passageway communicating with said fuel passageway in said main body and a vapor passageway communicating with said vapor passageway in said main body, main fuel valve means in said fuel passageway in said main body for controlling the flow of fuel through said fuel passageway, main vapor valve means in said vapor recovery passageway in said main body for opening and closing said vapor recovery passageway to the flow of vapor therethrough, manually operable main valve actuating means connected to said main fuel valve means and said main vapor valve means for opening said main fuel valve means and for controlling the rate of flow of fuel through said main fuel valve means and said fuel passageway and for opening said main vapor valve means, fuel flow sensing means mounted in said fuel passageway in said main body for sensing the rate of flow of fuel through said fuel passageway when said main fuel valve is open, auxiliary vapor valve means in said vapor passageway in said main body for controlling the rate of vapor flow through said vapor passageway when said main vapor valve means is open, and actuating means connected to said auxiliary vapor valve means and responsive to said fuel flow sensing means for opening said auxiliary valve means responsive to the rate of fuel flow through said fuel passageway to control the rate and thus the volume of vapor recovered in relation to the rate and thus the volume of fuel dispensed.

2. A nozzle according to claim 1 wherein said fuel flow sensing means comprises a sensing member mounted in said fuel passageway in the path of fuel flowing therethrough for varied movement in direct response to the rate of fuel flow through said fuel passageway.

3. A nozzle according to claim 2 wherein said actuating means for opening said auxiliary valve means comprises a movable member coupled to said sensing member for concomitant movement therewith and connected to said auxiliary valve means for opening said auxiliary valve means upon movement thereof.

4. A nozzle according to claim 1 wherein said auxiliary vapor valve means comprises needle valve means having a restricted flow passage defining a needle valve seat and a needle valve member movable toward and away from said valve seat to control the rate of vapor flow through said restricted flow passage.

5. A nozzle according to claim 4 wherein said fuel flow sensing means comprises a permanent magnet mounted in said fuel passageway for movement responsive to the rate of fuel flow through said fuel passageway.

6. A nozzle according to claim 5 wherein said auxiliary vapor valve actuating means comprises a follower magnet mounted on said needle valve member and magnetically coupled to said fuel flow sensing permanent magnet for moving said needle valve member responsive to movement of said fuel flow sensing magnet.

* * * * *